United States Patent [19]

Bouy et al.

[11] 4,026,782

[45] May 31, 1977

[54] ELECTROLYSIS CELL HAVING BIPOLAR ELEMENTS

[75] Inventors: Pierre Bouy, Enghien les-Baines; Hubert de Lachaux, Courbevoie; Michel Conan, Rueil Malmaison, all of France

[73] Assignee: Rhone-Poulenc Industries, Paris, France

[22] Filed: July 29, 1975

[21] Appl. No.: 600,068

[30] Foreign Application Priority Data

July 29, 1974 France ..... 74.26233

[52] U.S. Cl. ..... 204/254; 204/256; 204/279

[51] Int. Cl.[2] ..... C25B 1/16; C25B 1/26; C25B 7/00

[58] Field of Search ..... 204/253, 254, 268, 267, 204/279, 286, 252–258

[56] References Cited

UNITED STATES PATENTS

| | | | |
|---|---|---|---|
| 1,721,407 | 7/1929 | Pechkranz | 204/254 |
| 3,378,480 | 4/1968 | Reinshagen et al. | 204/279 X |
| 3,752,757 | 8/1973 | Stephenson et al. | 204/254 X |
| 3,778,362 | 12/1973 | Wiechers et al. | 204/254 |
| 3,873,437 | 3/1975 | Pulver | 204/254 |
| 3,875,040 | 4/1975 | Weltin et al. | 204/254 X |

*Primary Examiner*—Arthur C. Prescott

[57] ABSTRACT

The invention relates to an electrolysis cell having bipolar elements, characterized in that the recess between the bipolar elements and the impermeability between any two consecutive electrode frames are ensured by the peripheral surfaces opposite the said frames which have, on their most external part, a non-deformable rigid face forming a plane of contact resting against the plane of contact of the adjacent frame. At least one of the opposing surfaces has at least one recess in which at least one sealing member is arranged. The cell is particularly useful for the electrolysis of solutions of alkali salts.

11 Claims, 4 Drawing Figures

ELECTROLYSIS CELL HAVING BIPOLAR ELEMENTS

BACKGROUND OF THE INVENTION

The present invention relates to an electrolysis cell having bipolar elements for the electrolysis of, in particular, solutions of alkyl salts.

Electrolysis cells having bipolar elements have been known for a long time. They have the advantage of a compact structure and thus a saving in space and a facilitated supply of electricity due to the fact that the unit cells are connected in series.

Nevertheless, despite their obvious advantages such cells are still relatively little used. This is largely due to the difficulties experienced in producing these cells. In actual fact, these cells consist of bipolar elements arranged side by side which are generally kept in place by clamping or securing the two end elements. However, this involves mechanical-type constraints, and, in particular, the clamping must be uniform and the elements must be very rigid and must not change shape during use.

A bipolar electrode for an electrolysis cell has been proposed in de Lachaux et al application, U.S. Ser. No. 478,605, filed June 12, 1974 now U.S. Pat. No. 3,980,545, characterized in that the cathode and/or anode frames are integral with the bimetallic base plate of the electrode, the said plate serving as a plane of reference and the perpendicularity with respect to this plane being ensured for the anode and cathode parts by the current leads to which they are welded. These current leads act as stiffeners and produce the planarity of these electrode parts and their parallelism with respect to the plane of reference constituted by the metal base plate. This planarity is a necessary condition for the good operation of such a cell, which involves being able to control the interpolar distance between the two electrodes.

However, this planarity condition is not sufficient by itself; it is also necessary that the interpolar distance be kept constant during the operation of the cell. Important progress has been made in this respect by using as electrodes metal structures of film-forming metals, such as titanium or metals and alloys of similar anode properties in the construction thereof, the anodically active parts of these structures being covered with conducting layers which are not attacked by the electrolyte employed.

Such structures have not only enabled the height of the electrodes to be increased on the one hand and the current density per unit surface area to be increased on the other hand without causing any excess heating, but have also made it possible to maintain the interpolar distance constant because these structures, contrary to what takes place with graphite anodes, do not alter their dimensions when in operation.

However, the improvement employed to meet these two requirements of planarity and constant thickness of the electrodes has been found to leave something to be desired.

As mentioned above, it is known that cells of the filter-press type or similar types generally consist of anode and cathode elements kept in place by clamping or securing the end elements. Since electrolytic solutions are particularly corrosive, very strict conditions of "tightness" or impermeability from frame to frame have to be observed.

The solution of the problem employed in similar cases is to arrange a sealing member between two adjacent rigid units such as described for example in Bouy et al U.S. Pat. No. 3,836,448. However, although this solution gives good results, it is not entirely satisfactory since with modern cells of large dimensions and high current densities, employed to provide a high yield, attempts are being made to maintain these cells in operation for as long as possible without any special maintenance. It is found that the sealing members have a tendency to age, which results in a shrinkage of the members, and as a consequence the interpolar distance varies despite all the improvements brought about in other respects.

It is an object therefore, of the present invention to provide an electrolytic cell free from the disadvantages of the prior art.

It is also an object of the present invention to provide an electrolytic cell in which the distances between bipolar electrodes are maintained without change.

Other objects of the present invention will be apparent to those skilled in the art from the present disclosure, taken in conjunction with the appended drawings, in which.

GENERAL DESCRIPTION OF THE INVENTION

Figure 1:
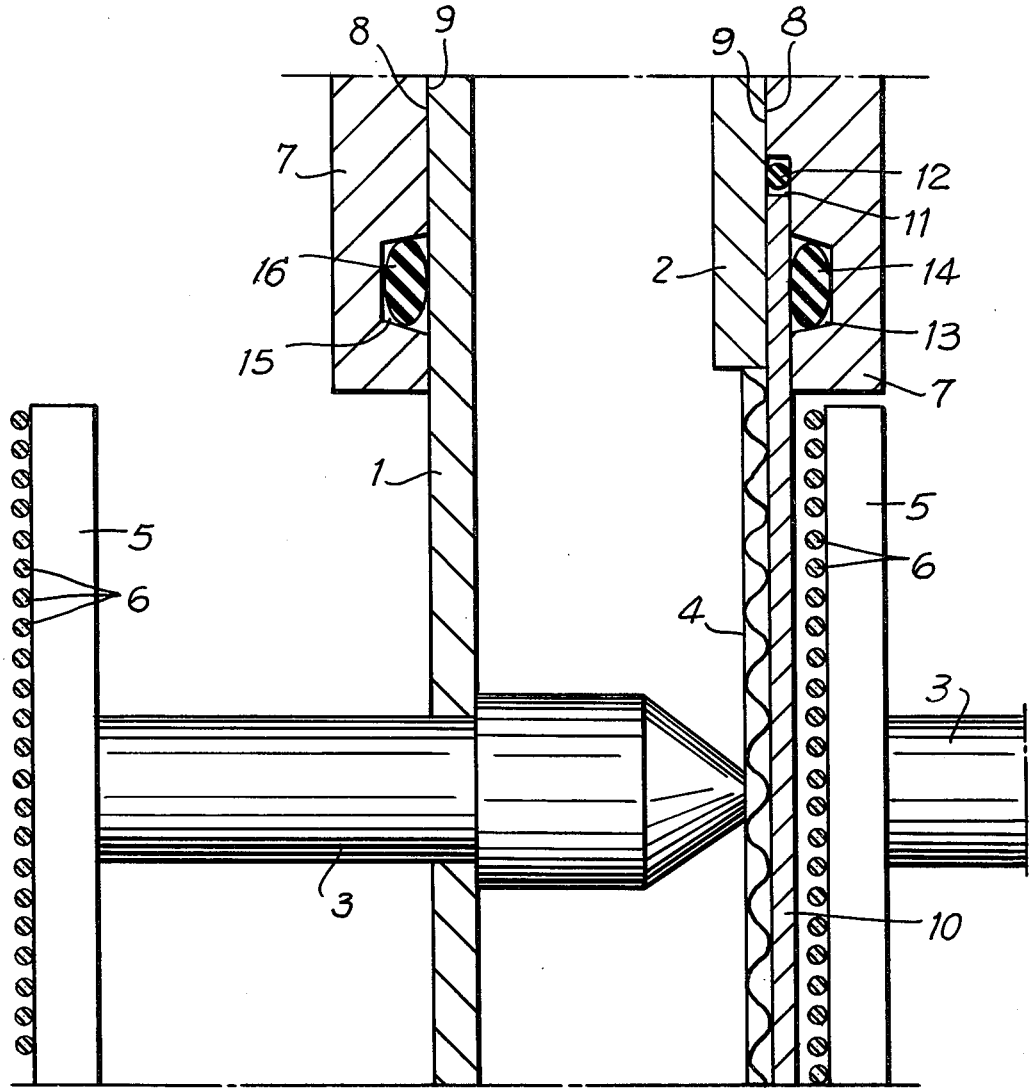
FIG. 1 is a bipolar electrode assembly of the present invention, taken in cross-section.

It has now been found, and this is a primary object of the present invention, that the disadvantages of the prior art can be obviated while ensuring the spacing between bipolar elements and the impermeability of two consecutive frames. This is done by providing that the opposing peripheral surfaces of said frames have a non-deformable rigid face on their most external part which forms a plane of contact just resting on the plane of contact of the following or adjacent frame, and at least one of the opposite surfaces presents at least one recess in which is arranged at least one sealing member. Thus, by virtue of the present invention the interpolar distance does not depend on the sealing member and is not dependant on its resistance to ageing. Advantageously, at least one elastically deformable sealing member is arranged in said recess.

The present invention also enables the diaphragm between electrodes to be kept in place in an advantageous manner. As is known, the said diaphragm, which are customarily employed in such cells should be kept tight without however being damaged.

Thus, in accordance with the present invention the diaphragm preferably just rests against the plane of contact of a frame opposite a recess in the adjacent frame and is kept in position by at least one elastically deformable sealing member resting against the diaphragm and arranged in the said recess of the adjacent frame. The elastically deformable member is advantageously arranged in a housing made in the said recess and having a shape which is adapted to the configuration of the sealing member.

The sealing member may be of any appropriate shape such as toroidal, rectangular, etc.

The present invention is applicable to all types of cells having bipolar elements, but in particular to frames described in the aforesaid de Lachaux et al U.S. application, Ser. No. 478,605; U.S. Pat. No. 3,884,781 and U.S. Pat. No. 3,836,448.

Such frames are generally made of a material consisting of moulded polyester or any other material rendered chemically inet, as regards the anode frame, and of a metallic material such as steel, as regards the cathode frame. The steel parts are obviously protected against corrosion, for example by means of a titanium sheet, or sheet of other film-forming metal, or by any other form of coating which is chemically inert with regard to the electrolyte.

In accordance with the invention the anode frame advantageously has on its circumference surrounding the electrolytically active part, a plane rigid part which just overlaps the opposite part of a cathode frame and, opposite each cathode frame circumference a recess in which an elastically deformable sealing member just fits, and in addition, as regards the diaphragm, a permanently deformable joining means above said diaphragm such as a putty or elastomer formed "in situ".

Of course, the present invention is also applicable to an integral anode frame, according to which the frame itself defines the cathode section and anode section at the same time. In this case, the means according to the invention is applicable in the same way to joining one bipolar element frame to another bipolar element frame.

SPECIFIC DESCRIPTION OF INVENTION

The present invention will be more easily understood with the aid of the following examples of carrying out the invention, given purely by way of illustration and not of limitation.

As shown in FIG. 1, the bipolar electrode comprises a base plate 1 consisting of a sheet of mixed metal formed from titanium and mild steel, in which is incorporated the cathode frame 2 of the electrode.

Stiffeners 3 serving as current leads connect the cathode section 4 of mild steel in the form of a lattice to the anode section. The anode section consists of an assemblage of titanium wires 6 welded to a support 5 of copper and titanium.

The stiffeners 3 have already been described in the aforesaid U.S. application, Ser. No. 478,605, and comprise a copper pass piece, not shown, soldered on the anode side to a copper-titanium support, and at least one current distribution steel piece on the cathode side, also not shown. The anode frames 7 are of molded rigid polyester.

In accordance with the invention, the anode frames 7 each have a plane of contact 8 which is applied to a corresponding plane of contact 9 of the opposite cathode frame 2.

According to the embodiment illustrated in FIG. 1, each anode frame has a recess. With regard to the cathode 4 on which rests a diaphragm 10, this recess comprises a seating 11 in which the diaphragm 10 just fits and, above the diaphragm 10, a permanently deformable sealing member 12 made of a material, such as putty or an elastomer formed "in situ". This recess also comprises a second seating 13 which receives a sealing member 14 made of an elastically deformable material.

The member 14 may in particular be formed from a natural rubber or a synthetic rubber such as polyethylene polypropylene copolymers, fluorinated hydrocarbon elastomers, butyl or nitrile rubber, etc.

In this way the diaphragm 10 is kept in place between the contact plane 9 of the cathode frame inert, the sealing member 14.

On the side without a diaphragm the frame-to-frame connection consists of two opposing planes of contact 8 and 9, and a recess reduced to a seating 15 shielding a toroidal sealing member 16 of an elastically deformable material identical or having properties similar to the member 14.

In accordance with the embodiment illustrated in FIG. 1, the sealing members such as 14 and 16 are toroidal members. However, other forms of sealing members may clearly be used, and in this case it is sufficient to give the seatings 13 and 15 a shape which is adapted to the configuration of the sealing members.

Figure 2:
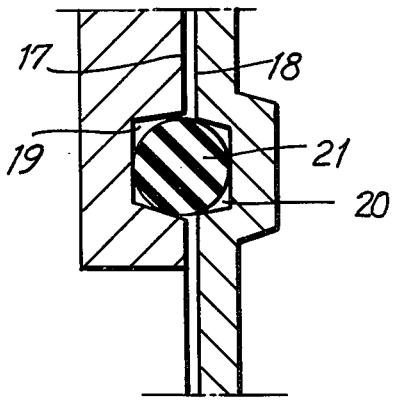
FIG. 2 is a diagrammatic representation of another bipolar electrode connecting means.
Figure 3:
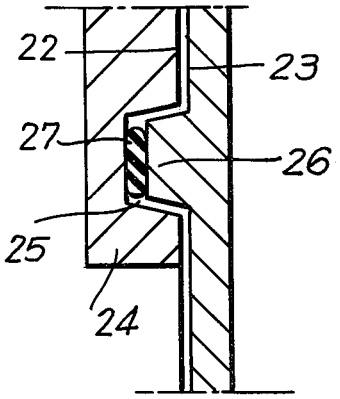
FIG. 3 is a diagrammatic representation of another bipolar electrode connecting means.

FIGS. 2 and 3 show diagrammatically other embodiments of the connecting means according to the invention.

Thus, according to FIG. 2, the two anode and cathode frames have two contact planes 17 and 18 facing one another and two recesses 19 and 20, also opposite one another, which form a space in which a sealing member 21 just fits.

The arrangement according to FIG. 3. shows diagrammatically an embodiment using a flat sealing member.

According to this embodiment the two frames have two contact planes 22 and 23 opposite one another, but only the anode frame 24 has a recess 25. The cathode frame has, on the contrary, a projecting portion 26 which just fits into the recess 25, and a sealing member 27 is arranged between the two.

Figure 4:
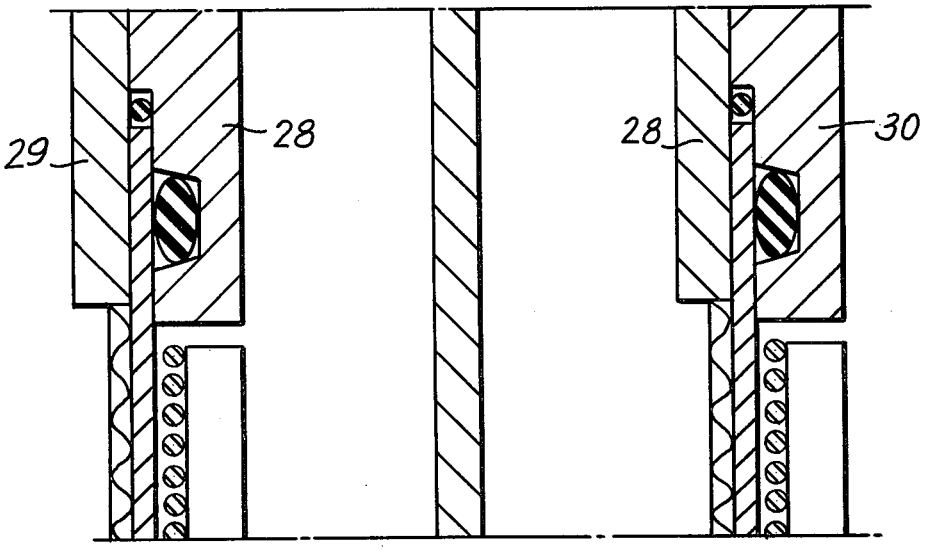
FIG. 4 is a diagrammatic representation of another embodiment of the invention showing another means for connecting electrodes.

FIG. 4 illustrates an embodiment according to which the connection is made from bipolar element to bipolar element, each element having a single frame such as 28, which is identical and adjacent to the following frames 29 and 30.

The previous examples, which are in no way limitative, show that a connection may be made in a simple manner, which furthermore has the advantage of ensuring a good positioning of the diaphragm, this factor being very important since the diaphragm, which is a vital element, is also very fragile.

The terms and expressions which have been employed are used as terms of description and not of limitation, nd there is no intention in the use of such terms and expressions of excluding any equivalents of the features shown and described or portions thereof, but it is recognized that various modifications are possible within the scope of the invention claimed.

What is claimed is:

1. An electrolysis cell having bipolar elements arranged side by side, having at lest two peripheral frames surrounding at least one compartment of the electrolysis zone, and being equipped with a diaphragm, wherein the impermeable connection between two consecutive frames is ensured by intimate contact of their opposing peripheral surfaces which have, on their most external section, a non-deformable rigid face forming a plane of contact resting on the plane of contact of the adjacent frame, one at least of the opposite surfaces having at least one recess in which at least one elastic sealing member is arranged, and in that said diaphragm rests against the plane of contact of a frame opposite a recess in the adjacent frame and is kept in position by an elastically deformable sealing member arranged in the said recess of an adjacent frame.

2. An electrolysis cell having bipolar elements according to claim 1, wherein at least one elastically deformable sealing member is arranged in at least one recess.

3. An electrolysis cell having bipolar elements according to claim 2, wherein a permanently deformable sealing member is arranged in a recess of an adjacent frame above the diaphragm and the elastically deformable sealing member.

4. An electrolysis cell having bipolar elements according to claim 1, wherein each bipolar element has a peripheral frame, one face of which comprises a plane of contact and the other face comprises a plane of contact, and at least one recess having at least one sealing member, the face of an element comprising a plane of contact opposite the face of another element comprising a plane of contact and at least one recess having at least one sealing member.

5. An electrolysis cell having bipolar elements according to claim 1, wherein each anode compartment has a peripheral frame containing on each face opposite the corresponding cathode compartment, at least one plane of contact and at least one recess in which is place at least one sealing member.

6. An electrolysis cell having bipolar elements according to claim 1, wherein at least one frame has a projecting section which just fits in a recess of the adjacent frame.

7. An electrolysis cell having bipolar elements according to claim 5, wherein each cathode frame opposite each anode frame has a plane of contact which extends opposite each recess in the anode frame.

8. An electrolysis cell having bipolar elements according to claim 1, wherein at least one elastically deformable sealing member is placed inside the recess in a seating adapted to the configuration of the said member.

9. An electrolysis cell having bipolar elements according to claim 1, wherein at least one elastically deformable sealing member consists of a toroidal member.

10. An electrolysis cell having bipolar elements according to claim 1, wherein at least one elastically deformable sealing member consists of a rectangular member.

11. An electrolysis cell having bipolar elements according to claim 1, wherein at least one elastically deformable sealing member consists of a flat member.

* * * * *

UNITED STATES PATENT AND TRADEMARK OFFICE

CERTIFICATE OF CORRECTION

PATENT NO. : 4,026,782

DATED : May 31, 1977

INVENTOR(S) : Pierre Bouy et al.

It is certified that error appears in the above-identified patent and that said Letters Patent are hereby corrected as shown below:

Column 1, line 8, delete "alkyl" and replace with -- alkali --.

Column 3, line 8, delete "inet" and replace with -- inert --.

Column 4, line 4, delete "inert".

Column 4, line 49, delete "nd" and replace with -- and --.

Column 4, line 56, delete "lest" and replace with -- least --.

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*